United States Patent [19]

Wong

[11] Patent Number: 4,882,555

[45] Date of Patent: Nov. 21, 1989

[54] PLURAL PLANE WAVEGUIDE COUPLER

[75] Inventor: Mon N. Wong, Torrance, Calif.

[73] Assignee: Hughes Aircraft Company, Los Angeles, Calif.

[21] Appl. No.: 231,326

[22] Filed: Aug. 12, 1988

[51] Int. Cl.[4] ..... H01P 5/18

[52] U.S. Cl. ..... 333/116; 333/238

[58] Field of Search ..... 333/116, 117, 238

[56] References Cited

U.S. PATENT DOCUMENTS

| | | | |
|---|---|---|---|
| 4,313,095 | 1/1982 | Jean-Frederic | 333/116 |
| 4,591,812 | 5/1986 | Stegens et al. | 333/116 |
| 4,737,740 | 4/1988 | Millican et al. | 333/116 |

*Primary Examiner*—Paul Gensler

*Attorney, Agent, or Firm*—Steven M. Mitchell; Wanda K. Denson-Low

[57] ABSTRACT

A quadrature hybrid coupler for coupling electromagnetic power between a first coplanar waveguide disposed on a first side of a circuit board and a second coplanar waveguide disposed on a second side of the circuit board is formed by means of a first pad and a second pad disposed in respective ones of the waveguides. The pads are formed as a widening of a central strip conductor of each of the waveguides. The pads are in registration with each other. Circumferential slots defining the pads are widened in proportion to a widening of the strip conductor to retain a characteristic impedance of the waveguides from ports of the coupler through the pads.

9 Claims, 2 Drawing Sheets

PLURAL PLANE WAVEGUIDE COUPLER

BACKGROUND OF THE INVENTION

This invention relates to coplanar waveguides formed within electrically conductive sheets disposed on opposite surfaces of a dielectric substrate and, more particularly, to a hybrid coupler of electromagnetic power between the waveguides.

Circuit boards comprising a dielectric substrate with opposed surfaces covered by metallic electrically-conductive sheets are often used for construction of waveguides for conducting electromagnetic power among electronic components, such as radiators of an antenna, filters, phase shifters, and other signal processing elements.

There are three forms of such circuit boards. One form, known as strip-line, comprises a laminated structure of three electrically conductive sheets spaced apart by two dielectric substrates. The middle sheet is etched to form strip conductors which cooperate with the outer sheets, which serve as ground planes, to transmit a TEM (transverse electromagnetic) wave. A second form of the circuit board, known as microstrip, is also provided as a laminated structure, but is simpler than the strip-line in that there are only two sheets of electrically conductive material, the two sheets being spaced apart by a single dielectric substrate. One of the sheets is etched to provide strip conductors which in cooperation with the other sheet, which serves as a ground plane, supports a TEM wave. The third form of circuit board is provided with a coplanar waveguide, and comprises two sheets of electrically conductive material spaced apart by a dielectric substrate. The coplanar waveguide is formed completely within one of the sheets and is constructed as a pair of parallel slots etched within a conductive sheet, the two slots defining a central strip conductor. The central strip conductor cooperates with outer edges of the slot to support a TEM wave.

The coplanar waveguide structure is of particular interest herein because of its utility in interconnecting microwave components by use of a circuit board, which may be employed to support these components. Also, a TEM wave can be transmitted via a coplanar waveguide independently of the presence or absence of a conductive sheet on the opposite side of the circuit board. This permits greater flexibility in the layout of the circuit board since electrical components can be mounted on both sides of the board.

In the use of the circuit boards, it is frequently necessary to couple a portion of the power from one waveguide to another waveguide for combining signals such as, for example, in the construction of a Butler matrix for distributing electromagnetic signals among elements of a phased array antenna. The capability for coupling electromagnetic signals between waveguides provides for greater flexibility in the layout of components on the circuit board. This is particularly true in situations wherein power is to be coupled through the board between a waveguide on one side to a waveguide on the opposite side of the board. Heretofore, such coupling has been accomplished by use of a feedthrough connector with appropriate impedance matching structures.

A problem arises in the use of feedthrough connectors in combination with coplanar waveguides in that additional manufacturing steps are required. For example, a coplanar waveguide can be manufactured by photolithography including an etching of the pair of parallel slots which define the central strip conductor. In order to provide the feedthrough connector, it is necessary to drill a hole through the dielectric substrate, and then to establish an electrically conducting path through the drilled hole. Various techniques are available for establishing the electrically conducting path, including plating as well as the insertion of a metallic post. The drilling of holes and insertion of posts are totally separate manufacturing processes from those employed in the photolithography for construction of the coplanar waveguide. In addition, such feedthrough connector may also require additional impedance-matching structures to avoid unwanted reflections from a discontinuity in the waveguide presented by the feedthrough connector.

SUMMARY OF THE INVENTION

The foregoing problem is overcome and other advantages are provided by a coupler of electromagnetic power between two coplanar waveguides or transmission lines wherein, in accordance with the invention, one of the waveguides is formed on a first side of a circuit board, and the second waveguide is formed on the opposite surface of the circuit board. The coupler is formed by a widening, in each of the waveguides, of the central strip conductor and two slots which define the central strip conductor to produce a pad at the site of the widening. The pad has a length, as measured along the strip conductor, of one/quarter of the guide wavelength in the band of interest of the electromagnetic power, the width of the pad being less than its length. The pads of the two waveguides are provided with the same dimensions, are located within the circuit boards such that one pad is above the other pad, and are oriented such that a long axis of one pad is oriented parallel to the long axis of the other pad. This brings both pads in registration with each other to maximize coupling between the two pads.

It is noted that the geometry of a cross section of a coplanar waveguide is selected such that the cross-sectional dimensions of the strip conductor and of the slots are comparable to, or less than, the spacing between the opposed sheets of the circuit board. This minimizes interaction and coupling between a coplanar waveguide on a surface of the board and a coplanar waveguide at the same location but on the opposite surface of the board. Upon enlarging the cross-sectional dimensions of the two waveguides, as is found in the construction of the pad, the coupling of electromagnetic power is greatly increased. As a feature of the invention for restraining coupling between waveguides on opposite sides of the board at all locations, except at the location of the coupler, incoming and outgoing sections of waveguide from the ends of the coupler are angled approximately 45 degrees relative to the center axis of a pad, thereby to divert the waveguide sections of one waveguide away from the waveguide sections of the other waveguide.

Waveguide sections on opposite sides of the pad of one of the waveguides, and waveguide sections on opposite sides of the pad of the other of the waveguides together provide for a set of four ports to the coupler. Upon application of an electromagnetic signal to a coupler port in a first of the waveguides, it is found that the opposite port, in the same waveguide, acts as a through port while, with respect to the remaining two ports in the second of the waveguides, the port nearest the first-mentioned port acts as the coupled port, while the fourth port acts as an isolation port. In addition, a 90 degree phase shift is imparted between electromagnetic signals coupled between the first and the third of the foregoing ports whereby the coupler of the invention functions as a quadrature hybrid coupler for transmittal of power through the dielectric substrate. The fraction of input power which is coupled from the first waveguide to the second waveguide depends on the amount of enlargement in the cross-sectional dimensions of a waveguide at the site of the coupler. Coupling of power ranging from −10 dB (decibels) to −3 dB has been accomplished. In the construction of the pads in each waveguide at the coupler, it is advantageous to enlarge both the slot width as well as the strip conductor width by approximately the same ratio so as to retain the characteristic impedance of the waveguide through the coupler. This is useful for minimizing reflections at the coupler.

BRIEF DESCRIPTION OF THE DRAWING

The aforementioned aspects and other features of the invention are explained in the following description, taken in connection with the accompanying drawing wherein.

DETAILED DESCRIPTION

Figure 1:
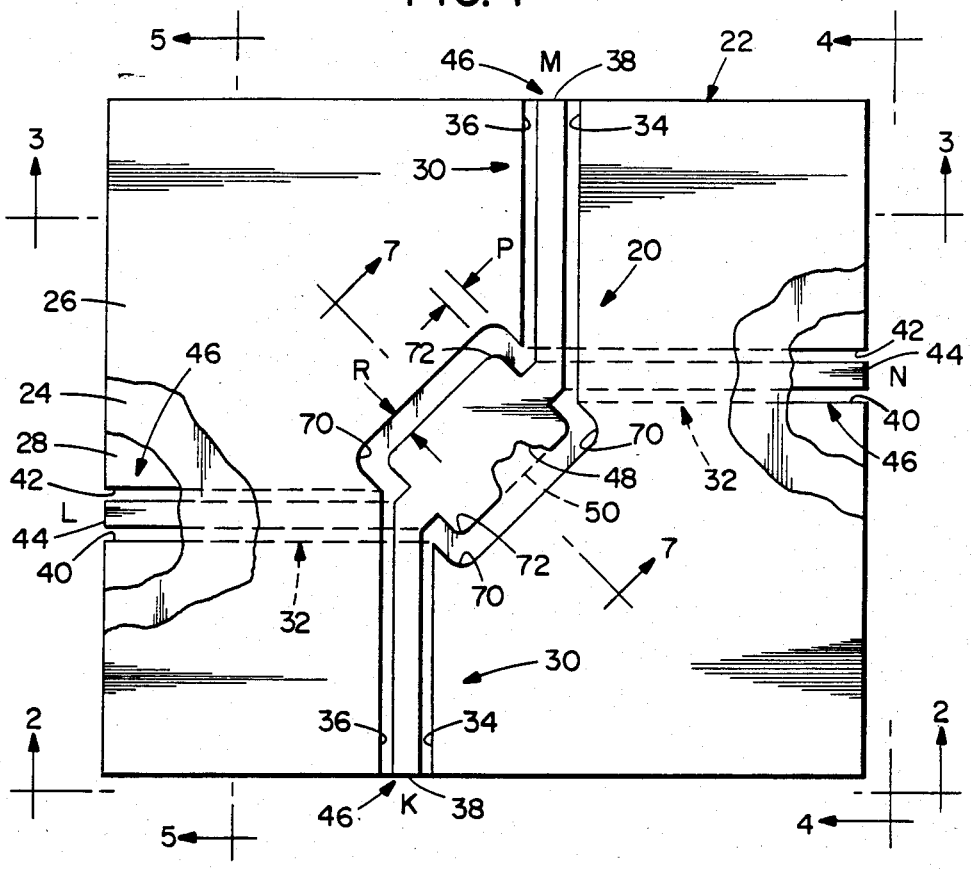
FIG. 1 is a plan view of a circuit board incorporating the hybrid coupler of the invention.
Figure 2:
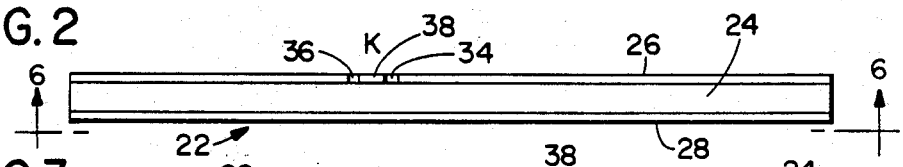
FIG. 2 is a side elevation view of the circuit board, taken along the line 2—2 of FIG. 1.
Figure 3:
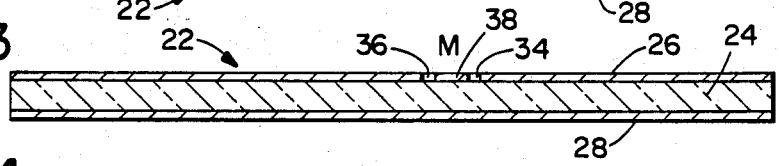
FIG. 3 is a sectional view of the circuit board, taken along the line 3—3 in FIG. 1.
Figure 4:
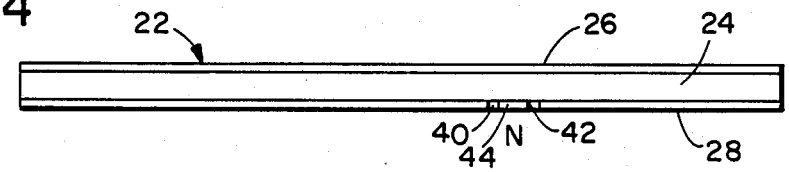
FIG. 4 is a side elevation view of the circuit board, taken along the line 4—4 in FIG. 1.
Figure 5:
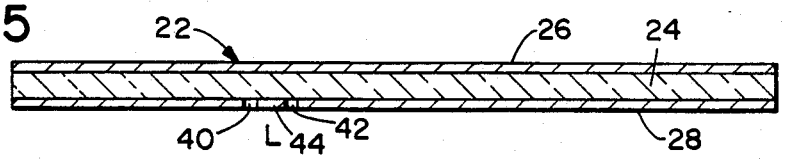
FIG. 5 is a sectional view of the circuit board, taken along the line 5—5 in FIG. 1.
Figure 6:
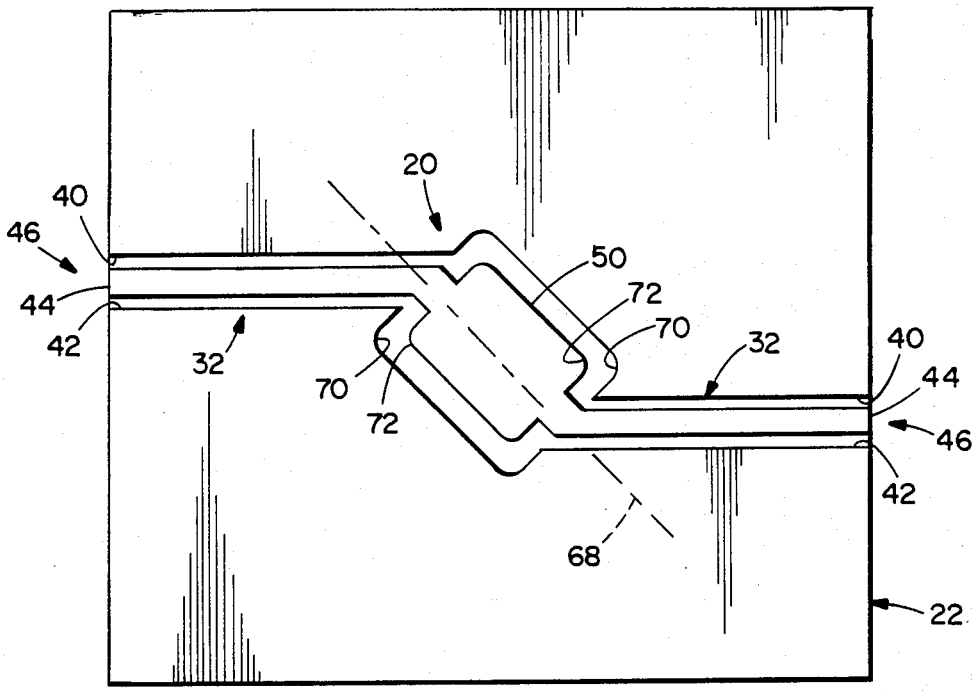
FIG. 6 is a plan view of the reverse side of the circuit board, taken along the line 6—6 in FIG. 2.
Figure 7:
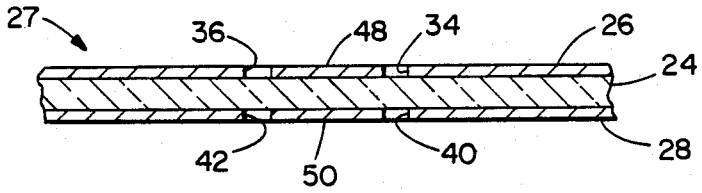
FIG. 7 is a fragmentary sectional view of the circuit board, taken along the line 7—7 in FIG. 1.

With reference to FIGS. 1–7, a microwave coupler 20 of the invention is constructed on a circuit board 22. The board 22 comprises a dielectric, electrically-insulating substrate 24, and top and bottom metallic, electrically-conductive sheets 26 and 28 disposed respectively on top and bottom surfaces of the substrate 24. The substrate 24 may be formed of a blend of glass fibers and a fluorinated hydrocarbon, such as Teflon, providing a dielectric constant of approximately 2.2. Typically,the metal used in the construction of the sheets 26 and 28 is copper. The terms "top" and "bottom" facilitate description of the invention by relating the orientation of the circuit board components to the arrangement shown in the drawing, and are not intended to describe the actual orientation of a physical embodiment of the circuit board which, in practice, may be oriented on its side or upside down.

Coplanar transmission lines, namely, waveguides 30 and 32 are formed respectively within the top and bottom sheets 26 and 28. Each of the waveguides 30 and 32 is formed by photolithographic techniques employing an etching of a pair of slots to define a strip conductor. In the waveguide 30, slots 34 and 36 define a strip conductor 38. In the waveguide 32, slots 40 and 42 define a strip conductor 44. The slots 34 and 36 in the waveguide 30, and the slots 40 and 42 in the waveguide 32 are spaced relatively close together and are parallel to each other to define ports 46 of the coupler 20. Individual ones of the ports 46 are identified further by the legends K, L, M, and N. At the coupler 20, the spacing between the slots 34 and 36 is enlarged to form a top pad 48 in the top sheet 26. Similarly, at the coupler 20, the spacing between the slots 40 and 42 is enlarged to form a bottom pad 50 in the bottom sheet 28. The widths of the slots 34 and 36 are increased at the periphery of the pad 48 so as to retain the same ratio between slot width and strip conductor width at the pad 48 as at the ports 46, thereby to retain the same characteristic impedance of the waveguide 30 at the pad 48. Similarly, the slots 40 and 42 are enlarged at the periphery of the bottom pad 50 to retain the same ratio of slot width to strip conductor width at the pad 50 as at the ports 46 to retain the same value of characteristic impedance of the waveguide 32 at the pad 50.

Figure 8:
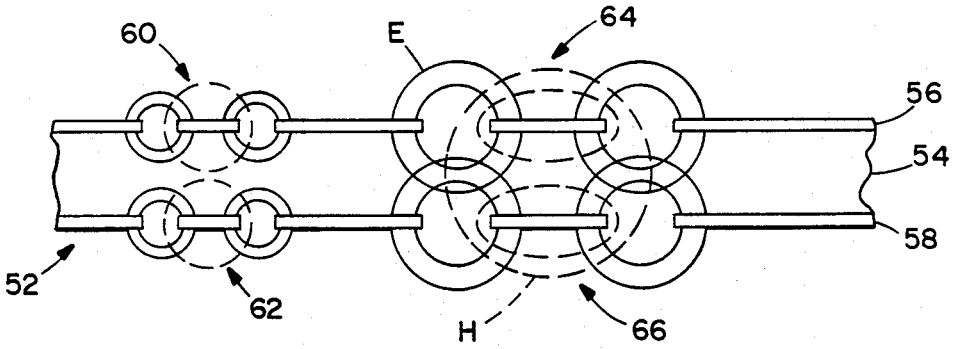
FIG. 8 is a schematic drawing of coplanar waveguides of differing dimensions to demonstrate coupling between coplanar waveguides on opposite sides of a circuit board.

FIG. 8 is a diagrammatic representation of an end view of a circuit board 52 having the same configuration as the circuit board 22 (FIG. 1), and being formed of a dielectric substrate 54 clad on top and bottom surfaces with metallic sheets 56 and 58. Four transmission lines in the form of coplanar waveguides 60, 62, 64 and 66 are shown on the board 52. The waveguides 60 and 62 have a relatively narrow cross section, and are disposed respectively in the top and the bottom sheets 56 and 58. The two waveguides 64 and 66 are of relatively broad cross-sectional dimensions, and are disposed, respectively, in the top and the bottom sheets 56 and 58. An electromagnetic wave is shown propagating in each of the waveguides 60–66, the electromagnetic waves being indicated by an electric field, identified by the legend E and portrayed as a solid line, and a magnetic field, identified by the legend H and portrayed by a dashed line. In the narrow configuration of the waveguide 60 and 62, the fringing fields are retained close to the waveguide, while in the wider waveguides 64 and 66, the fringing fields extend further into the substrate 54 so as to allow for circulation of the magnetic field about the center strip conductors of the two waveguides 64 and 66. By analogy with the coupler 20 of FIG. 1, the narrow waveguides 60 and 62 represent the configurations of either of the waveguides 30 and 32 at a port 46. The widened configuration of the waveguides 64 and 66 represent the widened portions of the waveguides 30 and 32 at the pads 48 and 50. Thereby, it may be appreciated that the construction of the pads 48 and 50 introduces a significant increase in the amount of coupling between the waveguides 30 and 32.

Furthermore, as a further feature of the invention, in order to reduce coupling between the waveguides 30 and 32 at a distance from the coupler 20, the waveguides 30 and 32 are angled away from a center line 68 (FIG. 6) of the pads 48 and 50 to increase the distance between the waveguides 30 and 32. A typical value of the angulation is 45 degrees. The length of each of the pads 48 and 50 is approximately one-quarter wavelength, namely the guide wavelength, as measured along the center line 68, of the electromagnetic radiation propagating along the waveguides 30 and 32. The width of each of the pads 48 and 50 is less than the length of the pads. The pads are shown as rectangular in shape with the corners of the pads being rounded, and similarly the contiguous portions of the slots 34, 36, 40, and 42 may have rounded corners, if desired, to minimize reflections of electromagnetic signals propagating in the waveguides 30 and 32. The maintenance of a constant characteristic impedance throughout the waveguide 30 and its pad 48, as well as throughout the waveguide 32 and its pad 50, ensure a smooth flow of power with no more than a negligible amount of reflected power.

In the operation of the coupler 20, electromagnetic signals entering the coupler 20 via port K propagate past the pad 48 wherein a portion of the signal power is coupled out, the remaining portion of the signal continuing through the coupler 20 to exit by the port M. The portion of the signal coupled by the coupler 20 exits via the port L. The port N is an isolation port for signals entering via port K. It is noted that the construction of the coupler 20 is symmetrical, and that the transmission characteristic are reciprocal so that any one of the four ports 46 may serve as an input port.

A preferred embodiment of the invention has been constructed to operate at a frequency of 3 GHz (gigahertz). In this embodiment of the invention, the board 22 of FIG. 1 has a square shape and measures 2.5 inches on a side. The top and bottom sheets 26 and 28 are each made of copper to a thickness of 3 mils. The characteristic impedance of the waveguides 30 and 32 is 50 ohms. The dielectric constant of the substrate 24 is 2.2. At a −3 dB coupling ratio, the bandwidth is greater than 10 percent. The width of each slot 34, 36, 40 and 42 is 20 mils at the sites of the ports 46, and is enlarged to a width of 85 mils, dimension P, at the ends of the pads 48 and 50, the slot widths being widened to 71 mils, dimension R , at the sides of the pads 48 and 50. The width of each of the pads 48 and 50 is 306 mils. The length of each of the pads 48 and 50 is 684 mils. The width of each of the strip conductors 38 and 44 is 240 mils. The four outer corners 70 of the circumferential slot about the pads 48 and 50 are rounded to a radius of 250 mils. The four outer corners 72 of the pads 48 and 50 are rounded with a radius of 64 mils. The substrate 24 has a thickness of 58 mils. If desired, the bandwidth can be decreased by raising the dielectric constant of the substrate 24 as by use of alumina, for example.

The foregoing construction of the coupler 20 provides for the desired capability of the invention to couple a desired fraction of input electromagnetic power from a transmission line on one side of a circuit board to a transmission line on the opposite side of the circuit board. The electrical characteristics of the coupler 20 are that of a quadrature hybrid coupler wherein power inputted at port K is outputted partly at port M with essentially zero phase shift and partly at port L with a phase shift of +90 degrees. Essentially no power is outputted at port N; however, in the event that there were reflection at a load coupled to port L, such reflected power would exit partly at port N with the balance exiting at port K. It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. A coupler of electromagnetic power comprising:

a first electrically-conductive sheet;

a second electrically-conductive sheet;

means for supporting said second sheet parallel to said first sheet and spaced apart therefrom;

a first coplanar waveguide disposed in said first sheet;

a second coplanar waveguide disposed in said second sheet, each of said coplanar waveguides being formed as a pair of slots within a conductive sheet, the pair of slots being spaced apart to define a central strip conductor; and wherein in said first waveguide, there is a widened portion of each slot of said pair of slots and a widened portion of said strip conductor located within said widened slot portion, said widened portion of said strip conductor of said first waveguide being formed as a first elongated pad, said first pad having a length measured along said first waveguide of approximately one-quarter guide wavelength at a frequency of operation of the coupler;

in said second waveguide, there is a widened portion of each slot of said pair of slots and a widened portion of said strip conductor located within said widened slot portion, said widened portion of said strip conductor of said second waveguide being formed as a second elongated pad, said second pad having a length measured along said second waveguide of approximately one-quarter guide wavelength at said frequency of operation of the coupler; and said first pad is disposed in registration with said second pad for coupling electromagnetic power between said first and said second waveguides.

2. A coupler according to claim 1 wherein said pair of slots in each of said waveguides, at locations distant from said pads, define ports of said coupler, the slots in each of said pairs of slots being parallel to each other and angled at approximately 451 degrees relative to a center line of one of said pads, there being four of said ports allowing said coupler to function as a hybrid coupler.

3. A coupler according to claim 2 wherein said supporting means is a substrate of dielectric material disposed between said first sheet and said second sheet.

4. A coupler according to claim 1 wherein said supporting means is a substrate of dielectric material disposed between said first sheet and said second sheet.

5. A coupler according to claim 1 wherein each of said pads has a substantially rectangular shape.

6. A coupler according to claim 5 wherein each of said pads has rounded corners.

7. A coupler of electromagnetic power comprising:

a first electrically-conductive sheet;

a second electrically-conductive sheet;

means for supporting said second sheet parallel to said first sheet and spaced apart therefrom;

a first coplanar waveguide disposed in said first sheet;

a second coplanar waveguide disposed in said second sheet, each of said coplanar waveguides being formed as a pair of slots within a conductive sheet, the pair of slots being spaced apart to define a central strip conductor; and wherein in said first waveguide, there is a widened portion of each slot of said pair of slots and a widened portion of said central strip conductor located within said widened slot portion, said widened portion of said central strip conductor of said first waveguide being formed as a first elongated pad;

in said second waveguide, there is a widened portion of each slot of said pair of slots and a widened portion of said central strip conductor located within said widened slot portion, said widened portion of said central strip conductor of said second waveguide being formed as a second elongated pad;

said first pad is disposed in registration with said second pad for coupling electromagnetic power between said first and said second waveguides; and said central conductor and each of the slots of said pair of slots in each of said waveguide, at location distant from said pads, have cross-sectional dimensions which are less than or approximately equal to the spacing between said first sheet and said second sheet to inhibit coupling between said waveguides, said widened portion of each slot of said pair of slots and said widened portion of said central conductor in each of said waveguides enabling said coupling of electromagnetic power.

8. A coupler according to claim 7 wherein, in each of said waveguides, the pad has a length as measured along the waveguide of approximately one-quarter guide wavelength at a frequency of operation of the coupler.

9. A coupler of electromagnetic power comprising:

a first electrically-conductive sheet;

a second electrically-conductive sheet;

means for supporting said second sheet parallel to said first sheet and spaced apart therefrom;

a first coplanar waveguide disposed in said first sheet;

a second coplanar waveguide disposed in said second sheet, each of said coplanar waveguides being formed as a pair of slots within a conductive sheet, the pair of slots being spaced apart to define a central strip conductor; and wherein in said first waveguide, there is a widened portion of each slot of said pair of slots and a widened portion of said strip conductor located within said widened slot portion, said widened portion of said strip conductor of said first waveguide being formed as a first elongated pad;

in said second waveguide, there is a widened portion of each slot of said pair of slots and a widened portion of said strip conductor located within said widened slot portion, said widened portion of said strip conductor of said second waveguide being formed as a second elongated pad; and said first pad is disposed in registration with said second pad for coupling electromagnetic power between said first and said second waveguides.

* * * * *